US010443560B2

(12) United States Patent
Vogelbacher

(10) Patent No.: US 10,443,560 B2
(45) **Date of Patent: *Oct. 15, 2019**

(54) METHOD OF MANUFACTURING A CONTROL DEVICE FOR A VEHICLE

(71) Applicant: MAGNA ELECTRONICS INC., Auburn Hills, MI (US)

(72) Inventor: Michael Vogelbacher, Albbruck (DE)

(73) Assignee: MAGNA ELECTRONICS INC., Auburn Hills, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/890,389

(22) Filed: Feb. 7, 2018

(65) Prior Publication Data

US 2018/0180017 A1 Jun. 28, 2018

Related U.S. Application Data

(63) Continuation of application No. 14/810,797, filed on Jul. 28, 2015, now Pat. No. 9,890,760.

(60) Provisional application No. 62/030,211, filed on Jul. 29, 2014.

(51) Int. Cl.

| | |
|---|---|
| ***H01H 71/16*** | (2006.01) |
| ***F02P 19/02*** | (2006.01) |
| ***H01H 37/76*** | (2006.01) |

(52) U.S. Cl.

CPC ..... *F02P 19/027* (2013.01); *H01H 37/761* (2013.01); *F02P 19/023* (2013.01)

(58) Field of Classification Search

USPC ..... 361/103–105

See application file for complete search history.

(56) References Cited

U.S. PATENT DOCUMENTS

| | | | | |
|---|---|---|---|---|
| 4,442,804 | A | 4/1984 | Morgan | |
| 5,612,662 | A | 3/1997 | Drekmeier et al. | |
| 5,896,080 | A | 4/1999 | Chen | |
| 6,175,480 | B1 | 1/2001 | Karmazyn | |
| 9,476,398 | B2 * | 10/2016 | Biegert | F02P 19/027 |
| 9,890,760 | B2 | 2/2018 | Vogelbacher | |

(Continued)

FOREIGN PATENT DOCUMENTS

| | | |
|---|---|---|
| DE | 2058357 | 11/1970 |
| DE | 7520602 | 10/1975 |
| DE | 3930819 | 3/1991 |

(Continued)

*Primary Examiner* — Ronald W Leja

(74) *Attorney, Agent, or Firm* — Honigman LLP

(57) ABSTRACT

A method of manufacturing a control device suitable for use in a vehicle includes providing a housing, a circuit board, and thermal fuse. A first contact of the fuse is soldered at the circuit board at a first solder joint and a second contact is soldered at the circuit board at a second solder joint. During assembly of the circuit board at the housing, an engaging tab of the thermal fuse engages the housing whereby the housing urges the engaging tab and the first contact of the thermal fuse in a direction away from a surface of the circuit board. When the control device is assembled and in use, and when a temperature exceeds a threshold temperature so that the first solder joint at the first contact sufficiently melts, the first contact moves away from the circuit board to break the electrical connection at the first solder joint.

20 Claims, 4 Drawing Sheets

(56) References Cited

U.S. PATENT DOCUMENTS

| | | | |
|---|---|---|---|
| 2013/0298866 | A1 | 11/2013 | Vogelbacher |
| 2014/0355162 | A1 | 12/2014 | Biegert |

FOREIGN PATENT DOCUMENTS

| | | |
|---|---|---|
| DE | 4219554 | 12/1993 |
| DE | 4437122 | 4/1996 |
| DE | 19639427 | 3/1997 |
| DE | 19647035 | 11/1997 |
| DE | 10044081 | 4/2002 |
| DE | 10102235 | 8/2002 |
| DE | 102004014660 | 7/2005 |
| DE | 102005005549 | 8/2006 |
| DE | 102005014601 | 10/2006 |
| DE | 102006026406 | 12/2007 |
| DE | 102007035899 | 2/2009 |
| DE | 102008011226 | 8/2009 |
| DE | 102008057166 | 5/2010 |
| DE | 102008053182 | 7/2010 |
| DE | 102009036578 | 9/2010 |
| DE | 102011118724 | 5/2013 |
| EP | 1334505 | 8/2003 |
| EP | 1467603 | 10/2004 |
| EP | 1560242 | 8/2005 |
| EP | 2485355 | 8/2012 |
| FR | 2978324 | 1/2013 |
| WO | WO2004002202 | 12/2003 |
| WO | WO2010112389 | 10/2012 |

* cited by examiner

METHOD OF MANUFACTURING A CONTROL DEVICE FOR A VEHICLE

CROSS REFERENCE TO RELATED APPLICATIONS

The present application is a continuation of U.S. patent application Ser. No. 14/810,797, filed Jul. 28, 2015, now U.S. Pat. No. 9,890,760, which claims the filing benefits of U.S. provisional application Ser. No. 62/030,211, filed Jul. 29, 2014, which is hereby incorporated herein by reference in its entirety.

FIELD OF THE INVENTION

The present invention relates to control devices and, more particularly, to controls or control devices for controlling glow plugs for diesel engines.

BACKGROUND OF THE INVENTION

Glow plugs are known and are used to pre-heat diesel combustion engine cylinders before starting the engine, particularly when the diesel engine is cold. Devices for glow plug control devices are widely known in automotive applications. The controllers typically switch and control the current through glow plugs. The switched/controlled currents are comparably high. In cases where the metal-oxide-semiconductor field-effect transistors (MOS-FETs) become defective, there is the hazard that the glow plug current flow may not become turned off, and may continue to heat, which may lead to damage to the glow plug due to overheating or may lead to defects/slewing of power cables or discharged batteries.

To have a redundant instance to the MOS-FETs, fuses in the line of power are often implemented. Typically, one time fuses use bi-metals or the like and might be known but uncommon for that job. Solutions are known where the main power line becomes broke by one single fuse. Other solutions show power line bundles or one single fuse for each power line, which typically equates to the number of the cylinders of the engine.

SUMMARY OF THE INVENTION

The present invention provides a control device or control with a thermal fuse that functions as a thermal protection device or system for the control device. The thermal fuse has a first contact soldered at the circuit board at a first solder joint and a second contact soldered at the circuit board at a second solder joint. The thermal fuse is biased by a housing of the control device to exert a force at the circuit board in a direction away from a surface of the circuit board. The circuit element is electrically connected at the circuit board in closer proximity to the first contact of the thermal fuse than to the second contact of the thermal fuse. When a temperature at the circuit element exceeds a threshold temperature, the first solder joint at the first contact melts and the thermal fuse moves the first contact away from the circuit board to break the electrical connection at the first solder joint and between circuitry electrically connected to the first contact and circuitry electrically connected to the second contact. The thermal fuse may use through-hole technology (THT) to electrically connect to circuitry at the printed circuit board (PCB).

These and other objects, advantages, purposes and features of the present invention will become apparent upon review of the following specification in conjunction with the drawings.

DESCRIPTION OF THE PREFERRED EMBODIMENTS

Figure 1:
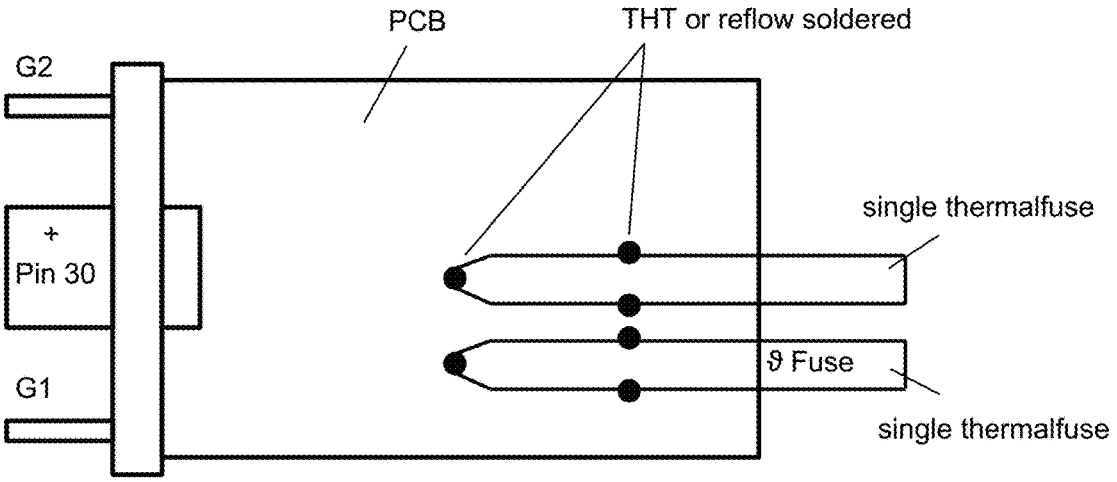
FIG. 1 shows a mechanical diagram of single glow plug control breaker fuses.
Figure 2:
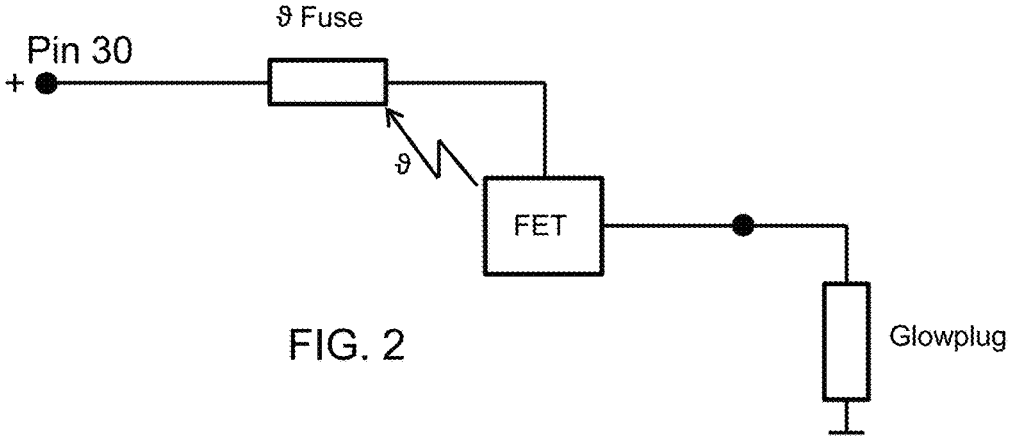
FIG. 2 shows a circuit diagram of a single glow plug control breaker fuse.
Figure 3A:
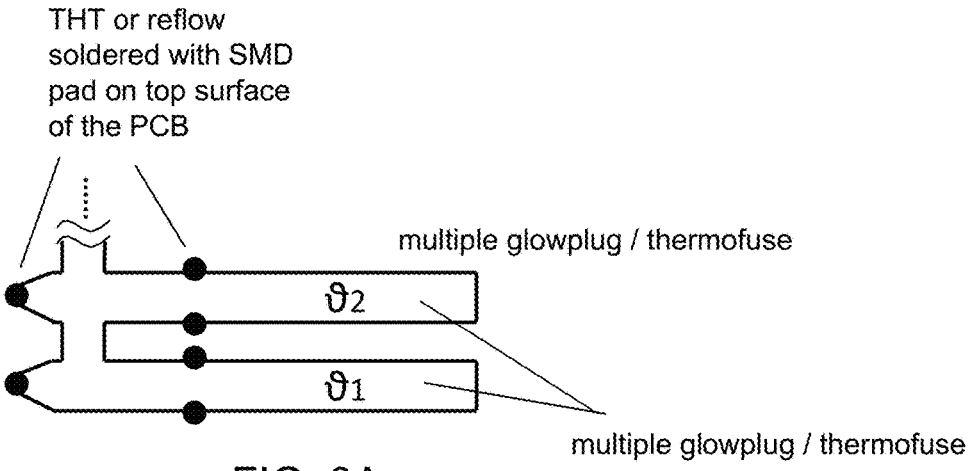
FIG. 3A shows a mechanical diagram of glow plug control breaker fuses with multiple contacts.
Figure 3B:
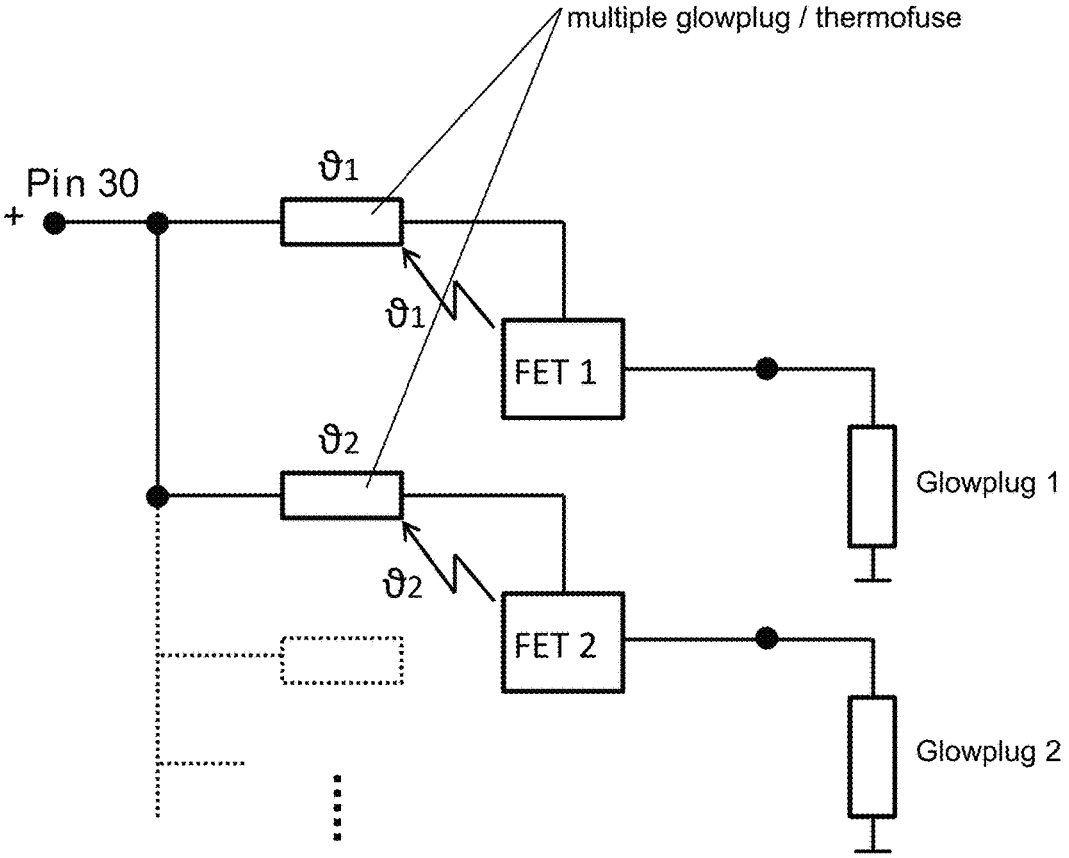
FIG. 3B shows a circuit diagram of a glow plug control with multiple glow plug control breaker fuses.

In diesel engine applications having a single fuse, if the main power line becomes broken by one single fuse, then after the fuse is gone, all of the glow plugs are out of function. If that should happen, then the engine may not be startable.

In diesel engine applications where each power line has its own fuse, such an arrangement allows the user to start the engine even though one fuse might be blown since the other cylinders are still heatable. However, more fuses cost more and take up more space.

The present invention provides preloaded springs that function to urge or move a device or element at the circuit board (such as a metal-oxide-semiconductor field-effect transistor or MOS-FET or other element or device of the circuit) when the circuit heats to a point where the solder holding the device or element at the circuit board becomes fluid. As soon as the solder becomes fluid, the spring load pushes or moves the device or element relative to the circuit board and out of contact with the conducting portion or contact portion of the circuit board, which breaks the current. Optionally, the present invention may utilize aspects of the control devices described in U.S. Publication Nos. US-2014-0355162 and/or US-2013-0298866, which are hereby incorporated herein by reference in their entireties.

As described in U.S. Publication No. US-2014-0355162 (incorporated above), thermal breaker fuses may be provided for glow plug control devices. In there the contact breaker comprises a functional electronic component which is biased out of position, thereby opening the contacts of the PCB pads by a spring force when the functional element heats up due to a short cut malfunction of the glow plug which leads to the melting of the element's solder. The spring is a separate element which gets tensioned (loaded) when the glow plug control housings lid becomes closed.

As described in U.S. Publication No. US-2013-0298866 (incorporated above), the breaker element is not an electronically functional element. In there the breaker incorporates the spring function, such as one spring possessing two breaker contacts each.

In European patent application No. 12152855.8 (which is hereby incorporated herein by reference in its entirety), the thermal breaker fuse of a vehicle cooling fan incorporates the shunt function as common function with the fuse function. In there the fuse falls off by gravity.

As additional aspects to the systems described in Publication No. US-2014-0355162 incorporated above, the system of the present invention combines the functional base ideas of the systems of U.S. Publication No. US-2013-0298866 and EP12152855.8. The fuse element has elastic properties by itself, and gets tensioned by closing the control device's housing, bracing at a housing's structure, and the fuse incorporates the function as current measuring shunt. Additionally, the fuse does not substantially heat up by the current load carried by itself but by one or more electrical devices (such as a FET or diode) in close proximity to the solder spot of the breaker fuse. The mounting at a PCB may utilize through-hole technology (THT) or surface mount device (SMD) technology. The application may be a control device for a Diesel engine glow plug control or a control of an automotive pump motor or a control of an automotive cooling fan or a control of an automotive alternator or a control of an automotive engine starter motor or a control of an automotive starter generator (combination of starter motor and alternator/generator) or the like.

Examples of the realization as thermal breaker fuse in a Diesel engine glow plug control device in accordance with the present invention are shown in FIGS. 1-6. The system of the present invention thus provides one or more thermal fuses at a circuit board or element of a control, such as for a Diesel engine glow plug.

Figure 4:
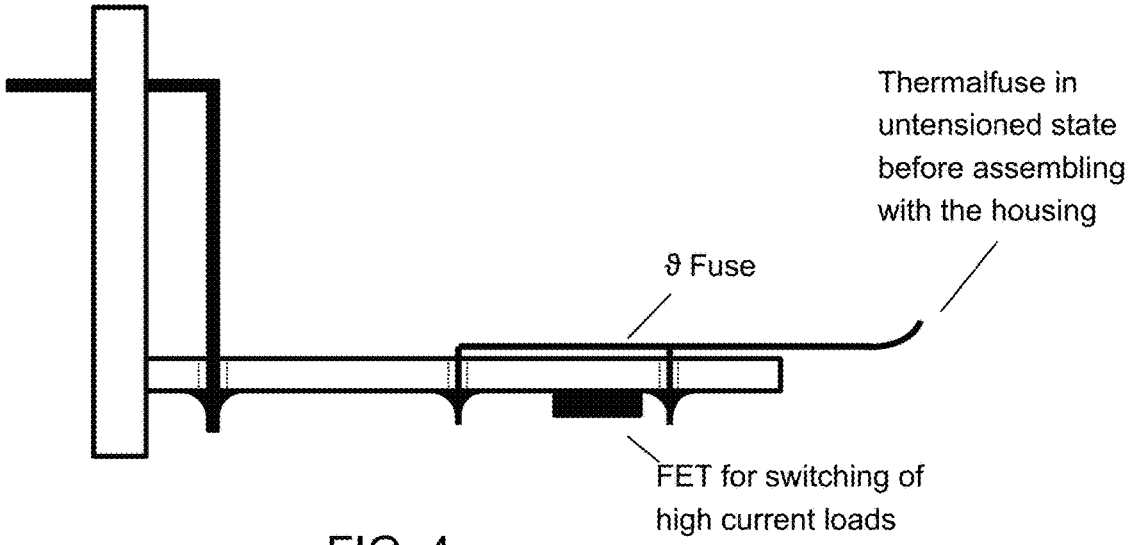
FIG. 4 shows a THT thermal breaker fuse of the present invention in an untensioned state in which it rests before the housing gets mated with the PCB that the breaker is soldered into.

As shown in FIG. 4, a THT thermal breaker fuse is disposed at a circuit element in untensioned state, where it rests at the circuit element or board before the housing gets mated with the PCB or circuit element or board at which the breaker is soldered. The fuse is soldered to the PCB at two locations, with one solder location or joint being closer to the end of the fuse that will engage the housing (and closer to the FET that may overheat) and the other solder location or joint being remote from or distal from the end of the fuse that will engage the housing (and preferably remote from the FET that may overheat).

Figure 5:
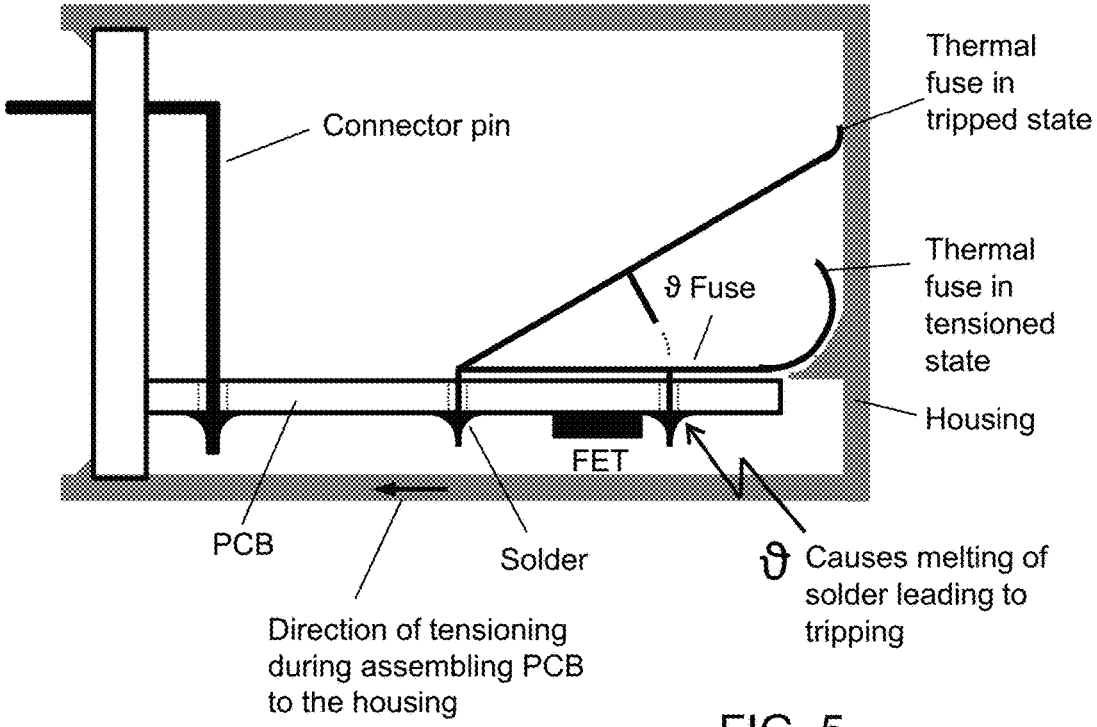
FIG. 5 shows the THT thermal breaker fuse of FIG. 4 as it gets tensioned when the housing is mated with the PCB that the breaker is soldered into.

As shown in FIG. 5, as the housing is moved into position (such as moving right to left in FIG. 5), the THT thermal breaker fuse part gets tensioned as a tab of the housing engages the end of the thermal fuse as the housing gets mated with the PCB at which the breaker is soldered. The tab of the housing is angled or curved so that, as it is moved towards the thermal fuse, it causes the thermal fuse to flex and be urged or biased away from the circuit element or PCB (with the material properties of the fuse, which may comprise a flexible metallic fuse element, causing the fuse element to be biased towards its initial or home or non-flexed state). The thermal fuse is soldered at and between electrical contacts, whereby, when the solder (such as the solder at the solder location or joint closer to the FET and closer to the end of the fuse that engages the housing) heats up a sufficient amount, the solder joint fails and the thermal fuse is urged away from the PCB towards its non-flexed state, thereby disconnecting one of the thermal fuse contacts from the respective contact at the PCB.

Figure 6:
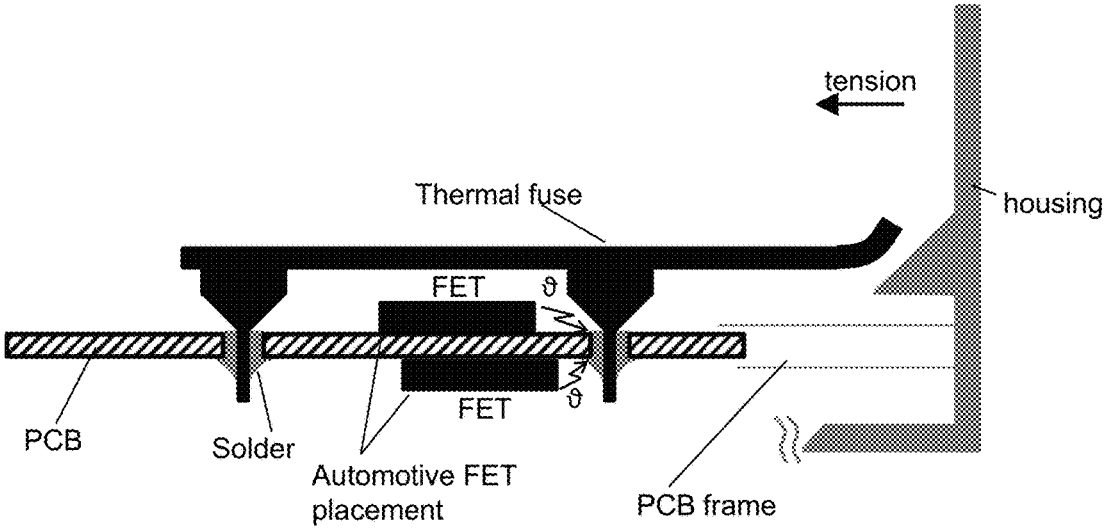
FIG. 6 shows a tensioned THT thermal breaker fuse of the present invention and its solder which gets passively heated by two FET components located close to the thermal breaker fuse's solder point, where the more distant point may not fully melt and may act more as a hinge and may prevent the thermal breaker from fully falling off or detaching after tripping (opening of the solder point close to the FETs).

As shown in FIG. 6, a tensioned THT thermal breaker fuse and its solder may get passively heated by two FET components located close to one of the thermal breaker fuse's solder points, where the more distant location or point or solder joint (more distant from the FET components) may not fully melt and may act more as a hinge and may prevent the thermal breaker from fully disengaging and falling off of the circuit board after tripping.

Thus, the thermal fuse of the present invention provides a safety function against high power dissipation losses in glow plug control devices (and optionally other control devices), and is capable to be used in various housing types, such as with horizontal PCBs or the like. The thermal fuse may be mounted by the basic structure or connector supplier, such as may be done with the terminals. Thus, no additional assembly steps are needed and no extra part handling is required to implement the spring action or biasing of the thermal fuse of the present invention.

Changes and modifications to the specifically described embodiments may be carried out without departing from the principles of the present invention, which is intended to be limited only by the scope of the appended claims as interpreted according to the principles of patent law.

The invention claimed is:

1. A method of manufacturing a control device suitable for use in a vehicle, said method comprising:

providing a housing;

providing a circuit board having a circuit element disposed thereat;

providing a thermal fuse having a first contact and a second contact;

soldering the first contact at the circuit board at a first solder joint;

soldering the second contact at the circuit board at a second solder joint;

wherein the circuit element is disposed at the circuit board in closer proximity to the first solder joint than to the second solder joint;

wherein, after soldering the first and second contacts at the circuit board, the thermal fuse is held in a flexed state via the first and second solder joints, and wherein the thermal fuse is biased towards an unflexed state;

assembling the circuit board at the housing;

during assembly of the circuit board at the housing, engaging an engaging tab of the thermal fuse with a portion of the housing whereby the portion of the housing urges the engaging tab and the first contact of the thermal fuse in a direction away from a surface of the circuit board; and wherein, when the control device is assembled and in use, and when a temperature at the circuit element exceeds a threshold temperature so that the first solder joint at the first contact sufficiently melts, the biasing of the thermal fuse towards the unflexed state urges and moves the first contact away from the circuit board to break the electrical connection at the first solder joint and between circuitry electrically connected to the first contact and circuitry electrically connected to the second contact.

2. The method of claim 1, wherein, when the engaging tab engages the portion of the housing during assembly of the circuit board at the housing, the thermal fuse flexes so that the engaging tab exerts a force at the circuit element.

3. The method of claim 1, wherein the engaging tab is at an end of the thermal fuse that is closer to the first contact than the second contact.

4. The method of claim 1, wherein the first contact is between the engaging tab and the second contact.

5. The method of claim 1, wherein the engaging tab comprises a curved portion of the thermal fuse, and wherein the portion of the housing comprises a curved surface that engages the engaging tab to urge flexing of the engaging tab during assembly of circuit board at the housing.

6. The method of claim 1, wherein, responsive to sufficient melting of the first solder joint at the first contact, the thermal fuse moves the first contact away from the circuit board while the thermal fuse remains attached at the circuit board via the second solder joint at the second contact.

7. The method of claim 1, wherein assembling the housing at the circuit board comprises moving the housing in a direction along the circuit board and engaging the engaging tab at an end of the thermal fuse.

8. The method of claim 7, wherein, after the housing engages the engaging tab of the thermal fuse while assembling the housing at the circuit board, and as the housing is moved further along the circuit board, the housing urges the end of the thermal fuse in the direction away from the circuit board.

9. The method of claim 1, wherein the control device comprises a glow plug control device for controlling at least one glow plug of a diesel engine of a vehicle.

10. The method of claim 1, wherein the thermal fuse comprises a metallic thermal fuse.

11. A method of manufacturing a control device suitable for use in a vehicle, said method comprising:

providing a housing;

providing a circuit board having a circuit element disposed thereat;

providing a thermal fuse having a first contact and a second contact, wherein the thermal fuse has an engaging tab at an end thereof, and wherein the first contact is between the engaging tab and the second contact;

wherein the thermal fuse comprises a metallic thermal fuse;

soldering the first contact at the circuit board at a first solder joint;

soldering the second contact at the circuit board at a second solder joint;

wherein the circuit element is disposed at the circuit board in closer proximity to the first solder joint than to the second solder joint;

wherein, after soldering the first and second contacts at the circuit board, the thermal fuse is held in a flexed state via the first and second solder joints, and wherein the thermal fuse is biased towards an unflexed state;

assembling the circuit board at the housing;

during assembly of the circuit board at the housing, engaging the engaging tab of the thermal fuse with a portion of the housing whereby the portion of the housing urges the engaging tab and the first contact of the thermal fuse in a direction away from a surface of the circuit board; and wherein, when the control device is assembled and in use, and when a temperature at the circuit element exceeds a threshold temperature so that the first solder joint at the first contact sufficiently melts, the biasing of the thermal fuse towards the unflexed state urges and moves the first contact away from the circuit board to break the electrical connection at the first solder joint and between circuitry electrically connected to the first contact and circuitry electrically connected to the second contact.

12. The method of claim 11, wherein, when the engaging tab engages the portion of the housing during assembly of the circuit board at the housing, the thermal fuse flexes so that the engaging tab exerts a force at the circuit element.

13. The method of claim 11, wherein the engaging tab comprises a curved end portion of the thermal fuse, and wherein the portion of the housing comprises a curved surface that engages the engaging tab to urge flexing of the engaging tab during assembly of circuit board at the housing.

14. The method of claim 11, wherein, responsive to sufficient melting of the first solder joint at the first contact, the thermal fuse moves the first contact away from the circuit board while the thermal fuse remains attached at the circuit board via the second solder joint at the second contact.

15. The method of claim 11, wherein the control device comprises a glow plug control device for controlling at least one glow plug of a diesel engine of a vehicle.

16. A method of manufacturing a control device suitable for use in a vehicle, said method comprising:

providing a housing;

providing a circuit board having a circuit element disposed thereat;

providing a thermal fuse having a first contact and a second contact;

soldering the first contact at the circuit board at a first solder joint;

soldering the second contact at the circuit board at a second solder joint;

wherein the circuit element is disposed at the circuit board in closer proximity to the first solder joint than to the second solder joint;

wherein, after soldering the first and second contacts at the circuit board, the thermal fuse is held in a flexed state via the first and second solder joints, and wherein the thermal fuse is biased towards an unflexed state;

assembling the circuit board at the housing;

during assembly of the circuit board at the housing, engaging an engaging tab of the thermal fuse with a portion of the housing whereby the portion of the housing urges the engaging tab and the first contact of the thermal fuse in a direction away from a surface of the circuit board;

wherein, when the engaging tab engages the portion of the housing during assembly of the circuit board at the housing, the thermal fuse flexes so that the engaging tab exerts a force at the circuit element;

wherein the engaging tab comprises a curved portion of the thermal fuse, and wherein the portion of the housing comprises a curved surface that engages the engaging tab to urge flexing of the engaging tab during assembly of circuit board at the housing; and wherein, when the control device is assembled and in use, and when a temperature at the circuit element exceeds a threshold temperature so that the first solder joint at the first contact sufficiently melts, the biasing of the thermal fuse towards the unflexed state urges and moves the first contact away from the circuit board to break the electrical connection at the first solder joint and between circuitry electrically connected to the first contact and circuitry electrically connected to the second contact.

17. The method of claim 16, wherein the engaging tab is at an end of the thermal fuse that is closer to the first contact than the second contact.

18. The method of claim 16, wherein assembling the housing at the circuit board comprises moving the housing in a direction along the circuit board and engaging the engaging tab at an end of the thermal fuse.

19. The method of claim 18, wherein, after the housing engages the engaging tab of the thermal fuse while assembling the housing at the circuit board, and as the housing is moved further along the circuit board, the housing urges the end of the thermal fuse in the direction away from the circuit board.

20. The method of claim 16, wherein the control device comprises a glow plug control device for controlling at least one glow plug of a diesel engine of a vehicle.

* * * * *